US010569141B2

(12) United States Patent
Lin

(10) Patent No.: US 10,569,141 B2
(45) Date of Patent: Feb. 25, 2020

(54) DOWN-PRESSED CLAMP BASE

(71) Applicant: XPIDER CO., LTD., Taichung (TW)

(72) Inventor: Louis Lin, Taichung (TW)

(73) Assignee: XPIDER CO., LTD., Taichung (TW)

( * ) Notice: Subject to any disclaimer, the term of this patent is extended or adjusted under 35 U.S.C. 154(b) by 0 days.

(21) Appl. No.: 16/399,539

(22) Filed: Apr. 30, 2019

(65) Prior Publication Data

US 2019/0366161 A1 Dec. 5, 2019

(30) Foreign Application Priority Data

May 29, 2018 (TW) ..... 107118362 A

(51) Int. Cl.
*A63B 51/14* (2006.01)

(52) U.S. Cl.
CPC ..... *A63B 51/14* (2013.01); *A63B 2051/143* (2013.01)

(58) Field of Classification Search
CPC ..... A63B 51/14; A63B 52/14; B25B 1/00
See application file for complete search history.

(56) References Cited

U.S. PATENT DOCUMENTS 5,090,697 A * 2/1992 Lee ..... A63B 51/16 473/555
5,186,459 A * 2/1993 Korte-Jungermann ..... A63B 51/14 473/539
5,338,028 A * 8/1994 Sung ..... A63B 51/16 473/556
6,398,674 B2 * 6/2002 Tsuchida ..... A63B 51/14 473/557
6,533,687 B1 * 3/2003 Lee ..... A63B 51/14 473/557
7,252,606 B1 * 8/2007 Lee ..... A63B 49/025 473/557
8,196,913 B2 * 6/2012 Lee ..... A63B 51/14 269/90
2008/0254922 A1 * 10/2008 Severa ..... A63B 51/14 473/556
2014/0315668 A1 * 10/2014 Zdrazila ..... A63B 51/14 473/556
2015/0258389 A1 * 9/2015 Zdrazila ..... A63B 51/14 473/557

* cited by examiner

*Primary Examiner* — Eugene L Kim
*Assistant Examiner* — Christopher Glenn
(74) *Attorney, Agent, or Firm* — Guice Patents PLLC

(57) ABSTRACT

A down-pressed clamp base includes: a main body having a space and a passage in communication with the space via a connection perforation; a transmission member fitted in the connection perforation; a leverage mechanism including a lever and a link, the link being pivotally connected with the lever and positioned in the passage, a free end of the link being directed to the transmission member; a fastening mechanism disposed in the space; and a string holding mechanism disposed on the main body for holding a racket string. When pressing down the leverage mechanism, the clamp base is fixed on the racket stringer in an operation mode meeting ergonomics. When the leverage mechanism is pressed down, the action forces of the lever, the link and the transmission member fall on the same straight line, whereby the clamp base is fixed on the racket stringer by a fixed fastening force.

11 Claims, 9 Drawing Sheets

DOWN-PRESSED CLAMP BASE

BACKGROUND OF THE INVENTION

1. Field of the Invention

The present invention relates generally to a racket stringer, and more particularly to a down-pressed clamp base, which is easily operable and has stable fastening force.

2. Description of the Related Art

Badminton and tennis games have become more and more prosperous. Also, the requirements for the rackets used in these games have become higher and higher. Therefore, it is critical how to string the racket face. FIG. 1 shows a conventional racket stringer. After the racket is stringed, a clamp base 90 is used to hold and secure the string. The clamp base 90 can be moved along a rail 91 of the racket stringer and fixed in a position. A clamp member 92 serves to hold the string, which is tensioned by a predetermined pound. Then the clamp member 92 can release the string and the clamp base 90 can be moved to a next position for holding the string.

Accordingly, in the stringing process, it is necessary to repeatedly fix the clamp base 90 on the rail 91 and release the clamp base 90. The conventional clamp base 90 has a rotary lever 93. By means of clockwise or counterclockwise rotating the rotary lever 93 to fix or release the clamp base 90, the bottom section of the clamp base 90 can fasten the rail 91 so as to fix the clamp base 90 on the rail 91. Reversely, when the bottom section of the clamp base 90 is released, the clamp base 90 can be moved along the rail 91.

However, in operation, the string is generally held by the clamp member 92 and then the clamp member 92 is released to rotate the rotary lever 93 for fixing the clamp base 90. At this time, the clamp base 90 is not yet fixed on the rail 91 so that when releasing the clamp member 92, an operator is easily to mis-operate the clamp base 90 and change the position thereof. As a result, it will be necessary to readjust the position of the clamp base 90. Moreover, in the conventional structure, in order to fasten the clamp base 90 on the rail 91, a user generally forcedly rotates the rotary lever 93 with the index finger and thumb. In the stringing process, it is necessary to fix and release the clamp base 90 many times so that after a long period of operation, the hand of the user is heavily burdened and the muscle of the user's hand is easy to get hurt. Furthermore, in case an excessive force is applied to the rotary lever 93, the bottom section of the clamp base 90 will be over-tightened on the rail 91. Under such circumstance, the user will have to exert greater force and cost more time to untighten the rotary lever 93. This leads to low stringing efficiency. In addition, the rotational operation of the rotary lever 93 fails to meet ergonomics and is not labor-saving or convenient. Therefore, those who are skilled in this field and on the market have long since tried to solve the problem how to more easily fix and release the clamp base 90 on the rail with effortless and keep a good fixing effect.

SUMMARY OF THE INVENTION

It is therefore a primary object of the present invention to provide a down-pressed clamp base, which can be fastened in a manner meeting ergonomics.

It is a further object of the present invention to provide the above down-pressed clamp base, which is easily operable with labor-saving.

It is still a further object of the present invention to provide the above down-pressed clamp base, which can be conveniently fixed on the rail of the racket stringer to hold the racket string without moving.

It is still a further object of the present invention to provide the above down-pressed clamp base, which can be locked on the rail of the racket stringer be a fixed fastening force without under-tightening or over-tightening so that the down-pressed clamp base will not fail to release due to over-tightening.

To achieve the above and other objects, the down-pressed clamp base of the present invention includes:

a main body having a space and a passage communicating with the space via a connection perforation;

a transmission member slidable disposed in the connection perforation, two ends of the transmission member being respectively directed to the passage and the space;

a leverage mechanism including a lever and a link, one end of the lever being a pivoted end pivotally connected with the main body, the other end of the lever being a levering section, the pivoted end of the lever having a pivot point, the lever being rotatable around the pivot point, one end of the link being a pivoted part pivotally connected with the lever, the other end of the link being a free end positioned in the passage and directed to the transmission member, when the levering section of the lever is rotated downward, the link being driven, whereby the free end of the link drives the transmission member to displace toward the space;

a fastening mechanism disposed in the space and drivable by the transmission member; and a string holding mechanism disposed on the main body.

Preferably, the down-pressed clamp base further includes a subsidiary leverage assembly having a subsidiary lever pivotally disposed on the main body. One end of the subsidiary lever is a force application section, while the other end of the subsidiary lever is a pushing section corresponding to the levering section of the lever. When operating the force application section of the subsidiary lever, the pushing section pushes the levering section of the lever to move upward.

Preferably, in the above down-pressed clamp base, a receiving cavity is disposed at the other end of the main body opposite to the space. The receiving cavity communicates with the passage. A pressing section protrudes from a rear end of the pivoted end of the lever. The pressing section is positioned in the receiving cavity. The string holding mechanism has a hollow tube disposed on the receiving cavity. A stem body is disposed under the bottom section of the clamp member. The stem body is slidably fitted in the tube, whereby when the clamp member drops down, a bottom end of the stem body presses the pressing section.

According to the above arrangement, when pressing down the lever, via the link, the lever pushes transmission member to drive the fastening mechanism so as to fix the clamp base on the rail of the racket stringer. The operation of the lever is convenient and labor-saving and meets ergonomics. When the lever is levered upward, the clamp base is released. Moreover, in the design of the present invention, when pressing down the levering section, the action forces of the lever, the link and the transmission member are collinear, whereby the clamp base is fixed on the racket stringer by a fixed fastening force without over-forcing or under-forcing.

In addition, when loosening the down-pressed clamp base, the lever can be alternatively operated by means of levering the subsidiary lever or making the string holding mechanism drop down.

The present invention can be best understood through the following description and accompanying drawings, wherein:

DETAILED DESCRIPTION OF THE PREFERRED EMBODIMENTS

Figure 1:
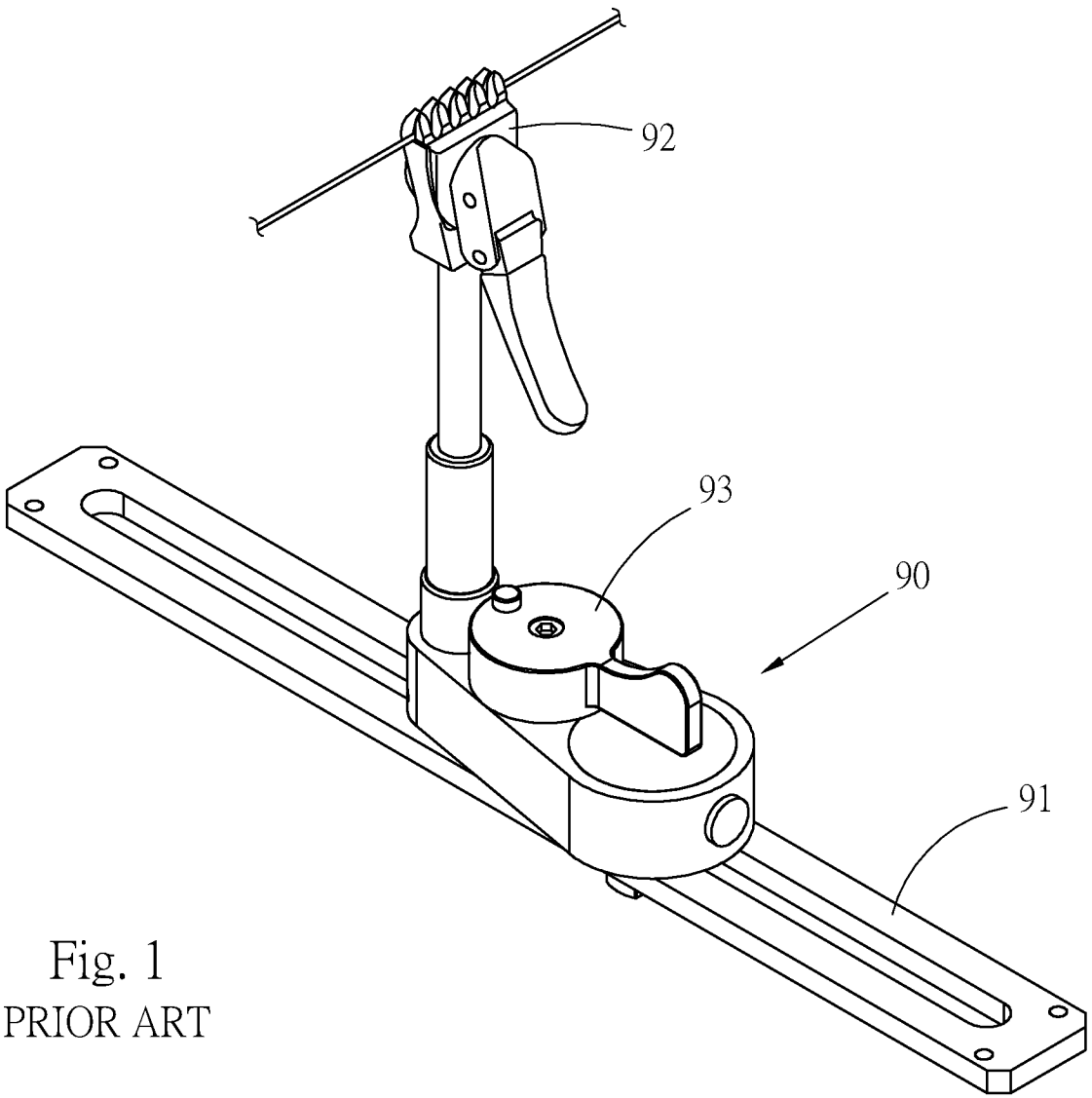
Fig. 1 PRIOR ART
FIG. 1 is a perspective view of a conventional string holder.
Figure 2:
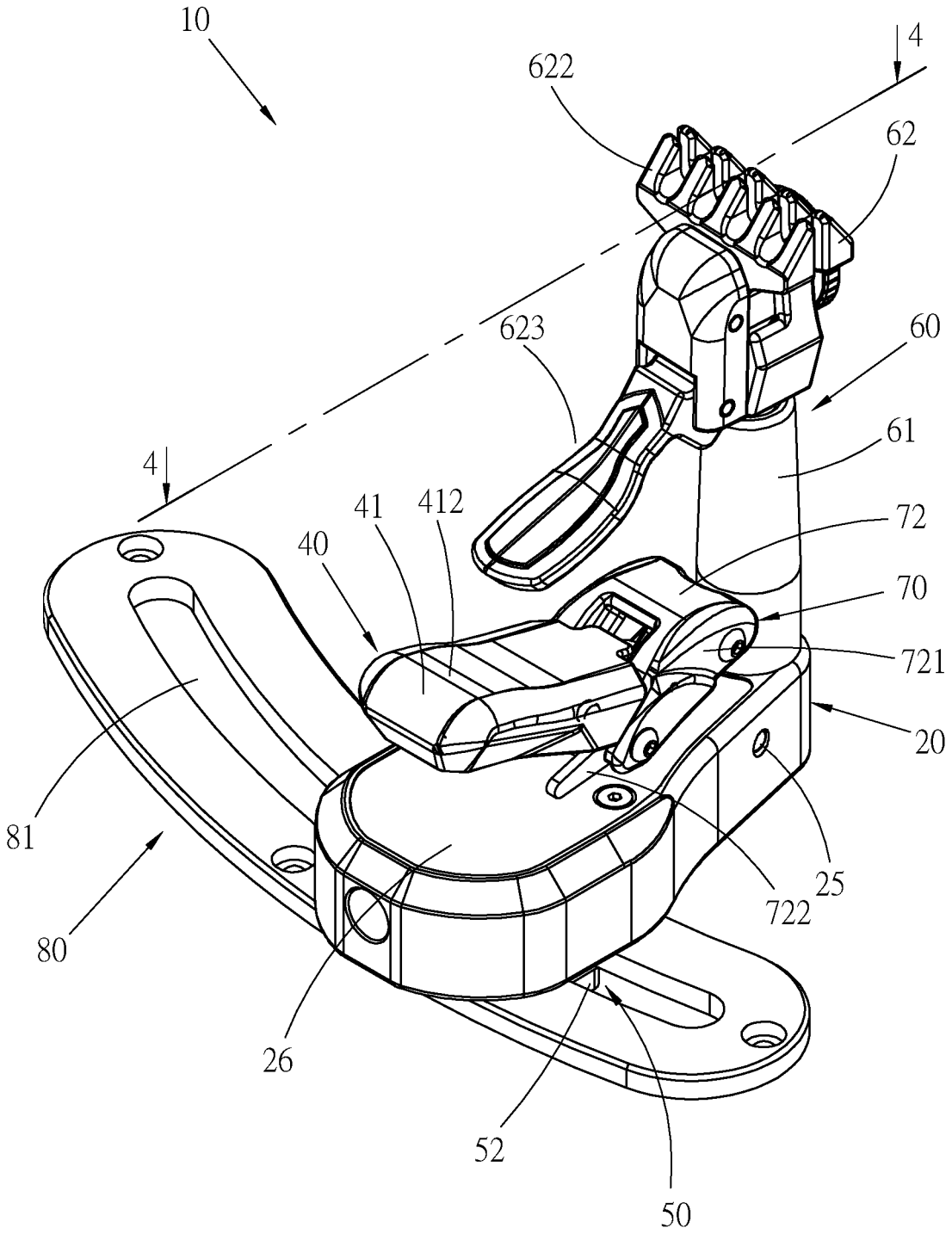
FIG. 2 is a perspective view of a preferred embodiment of the down-pressed clamp base of the present invention.
Figure 3:
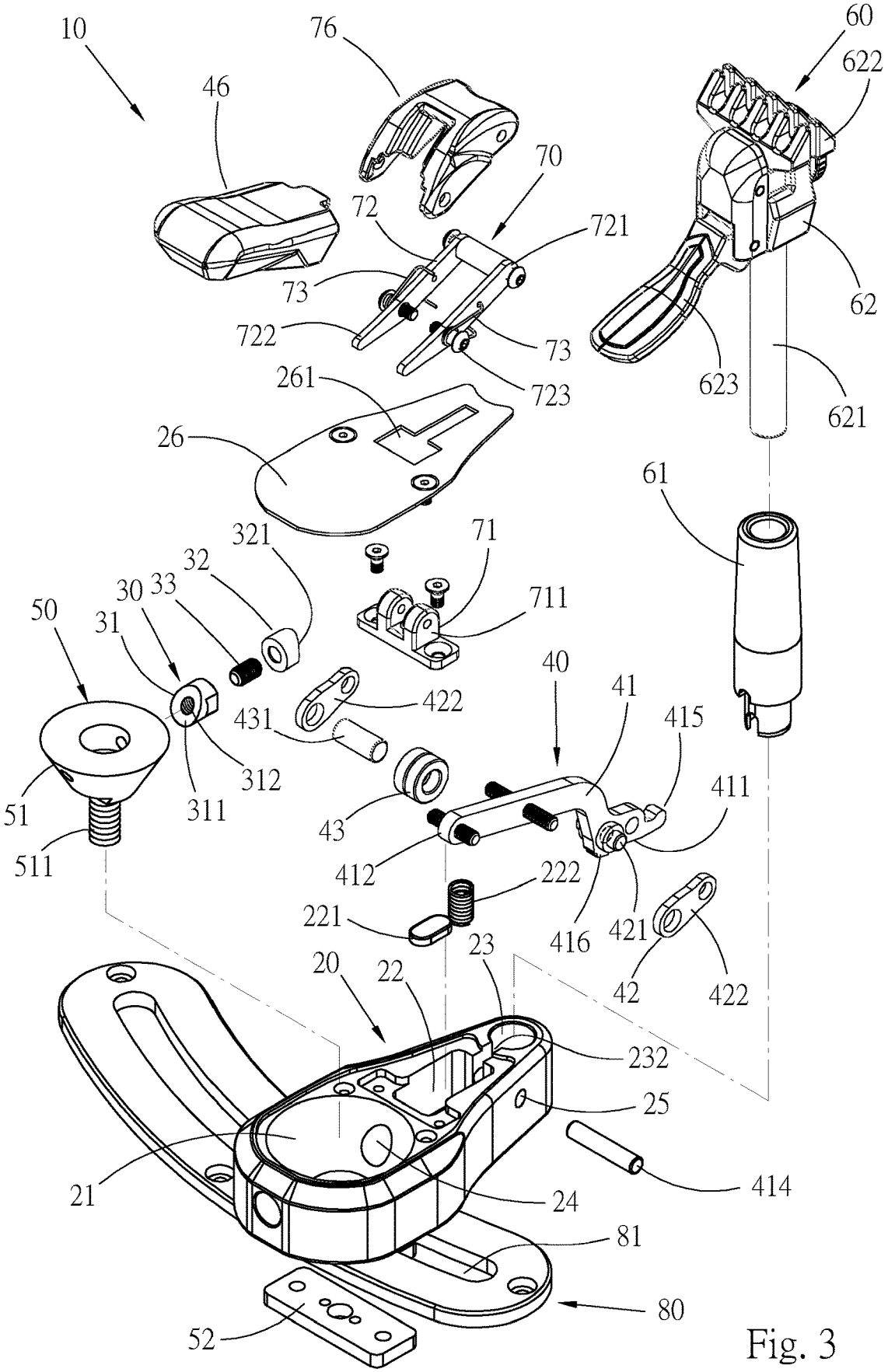
FIG. 3 is a perspective exploded view of the down-pressed clamp base of the present invention.
Figure 4:
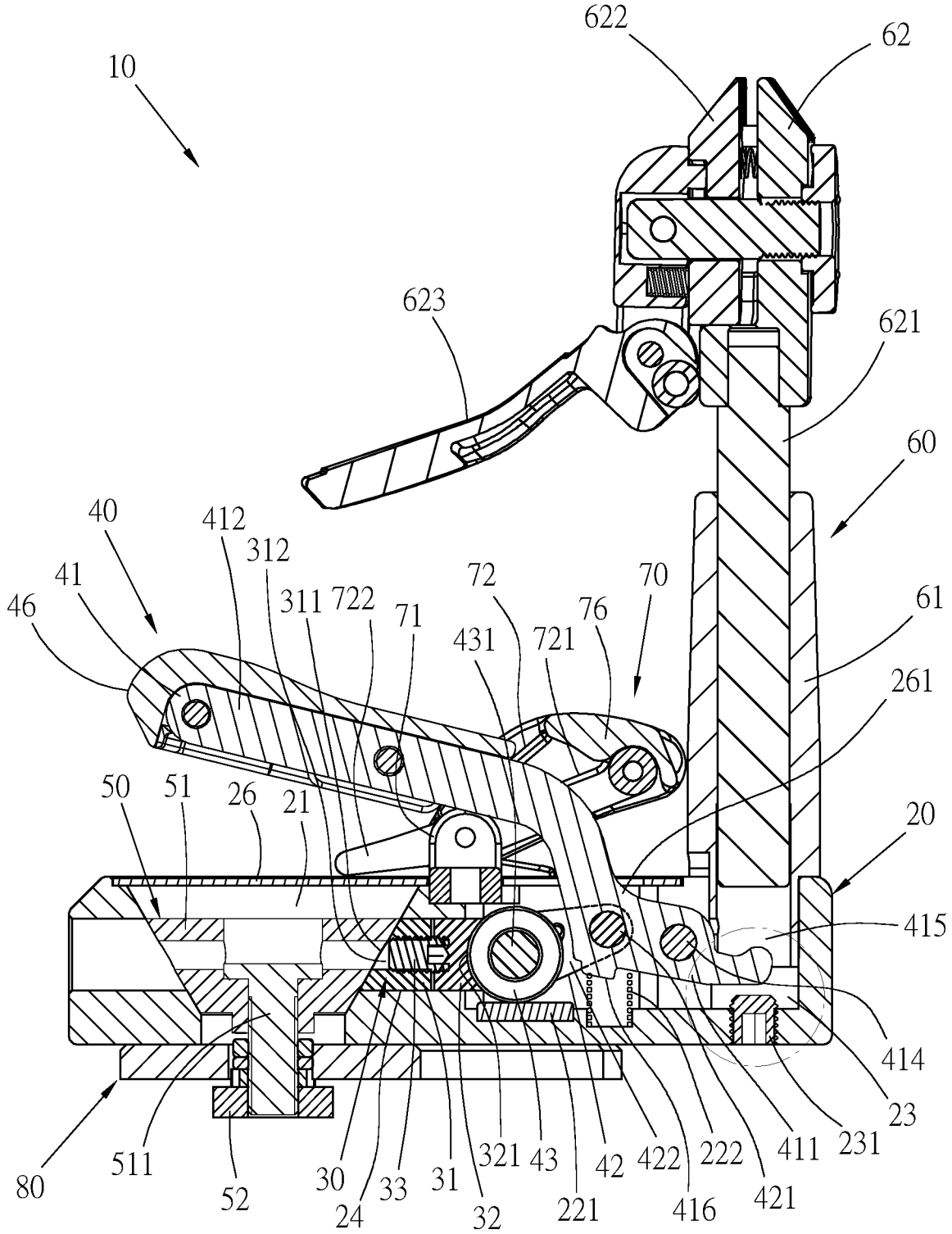
FIG. 4 is a sectional view taken along line 4-4 of FIG. 2, showing that the down-pressed clamp base is in an unlocked state.

Please refer to FIGS. 2 to 4. According to a preferred embodiment, the down-pressed clamp base 10 of the racket stringer of the present invention includes:

A main body 20, the main body 20 is sequentially formed with a space, a passage 22 and a receiving cavity 23 from one end to the other end. In this embodiment, the space is a downward tapered conic hole 21 at least passing through a bottom face of the main body 20. The passage 22 communicates with the conic hole 21 via a connection perforation 24. One end of the passage 22 is formed with a pivot hole 25 proximal to the receiving cavity 23. The pivot hole 25 is substantially normal to an axis of the connection perforation 24. A pad body 221 and an elastic member 222 are disposed on a bottom section of the passage 22. The pad body 221 is made of a material with lower friction and has a plane top face. The elastic member 222 is a compression spring. The receiving cavity 23 communicates with the passage 22 via a groove 232. An adjustment member 231, which is an adjustment screw, is screwed in a bottom section of the receiving cavity 23. The height of the adjustment member 231 is adjustable. A cover board 26 is mated with the main body 20 to cover the main body 20 so as to conceal the conic hole 21 and the passage 22.

A transmission member 30 slidably fitted through the connection perforation 24. Two ends of the transmission member 30 can respectively protrude into the conic hole 21 and the passage 22. In this embodiment, the transmission member 30 includes a slope block 31 and an arched block 32. The slope block 31 is proximal to the conic hole 21. An end face of the slope block 31 directed to the conic hole 21 is a slope 311. The slope block 31 is formed with a central threaded hole 312. An adjustment member 33 is screwed in the threaded hole 312. The adjustment member 33 can be a screw, which can be rotated within the threaded hole 312 to adjust the length protruding from the other end face of the slope block 31. One end of the adjustment member 33 is in contact with the arched block 32. The arched block 32 is proximal to the passage 22. An end face of the arched block 32 directed to the passage 22 is an arched face 321. The slope block 31 contacts the arched block 22 via the adjustment member 33. The length of the transmission member 30 is adjustable.

A leverage mechanism 40, which includes a lever 41 and a link 42. One end of the lever 41 is a pivoted end 411, while the other end of the lever 41 is formed with a levering section 412. The cover board 26 is formed with a window 261 for the lever 41 to extend through, whereby the levering section 412 is positioned outside the cover board 26. One end of the link 42 is a pivoted part, which is pivotally connected with the body of the lever 41 via a shaft rod 421 as a rotational fulcrum. The position of the pivoted part of the link 42, (that is, the position of the shaft rod 421), is between the pivoted end 411 and the levering section 412 of the lever 41. The pivoted end 411 of the lever 41 is pivotally connected at the pivot hole 25 of the main body 20 via a pin member 414, whereby the lever 41 is rotatable within the main body 20 around the pin 414. A pressing section 415 protrudes from the rear end of the pivoted end 411. The pressing section 415 extends into the receiving cavity 23. One end of the elastic member 222 positioned in the passage 22 is fitted with a protrusion block 416 under the bottom of the lever 41. The elastic member 222 serves to provide an elastic energy to always push the lever 41 upward. A rolling member 43 is pivotally disposed at the free end of the link 42 via a pivot pin 431 and received in the passage 22. The rolling member 43 can roll on the pad body 221 and contact with the arched block 32 of the transmission member 30. In this embodiment, the link 42 is composed of two side-by-side arranged arm members 422. One end of the two arm members 422 are pivotally disposed on two sides of the shaft rod 421. The rolling member 43 is pivotally disposed at the free ends of the two arm members 422 via the pivot pin 431. In this embodiment, the rolling member 43 is a roller. The pad body 222 can reduce the frictional force against the roller. An outer circumference of the rolling member 43 abuts against the arched face 321 of the transmission member 30.

A fastening mechanism 50, which includes an operation block and a clamping block 52. In this embodiment, the operation block is a conic block 51 received in the conic hole 21. The transmission member 30 serves to push the conic block 51 to move up and down. A connection rod 511 extends from the bottom of the conic block 51, which is a threaded rod. The clamping block 52 is screwed on the connection rod 511.

A string holding mechanism 60 have a hollow tube 61 assembled in the receiving cavity 23. A clamp member 62 is mounted on the tube 61. A stem body 621 is fixedly disposed under the bottom end of the clamp member 62. The stem body 621 is up and down movably fitted in the tube 61. The length of the stem body 621 is longer than that of the tube 61, whereby the bottom of the stem body 621 of the clamp member 62 can touch the pressing section 415 of the lever 41. Two opposite holding jaws 622 and a rotary bar 623 are disposed on the clamp member 62. The rotary bar 623 can be rotated to adjust the gap between the holding jaws 622. When the gap between the holding jaws 622 is minified, the string is held. The clamp member 62 of the string holding mechanism 60 pertains to prior art and is not the subject of the present invention so that the clamp member 62 will not be further described hereinafter.

A subsidiary leverage assembly 70, which includes a shafted block 71, a subsidiary lever 72 and at least one elastic element 73. The shafted block 71 is fixed on the top face of the main body 20 or integrally formed on the main body 20. The subsidiary lever 72 is pivotally connected at the lugs 711 of the shafted block 71 and rotatable. One end of the subsidiary lever 72 is a force application section 721, while the other end is a pushing section 722. The pushing section 722 is positioned on the same side as the levering section 412 of the lever 41 and under the levering section 412. The force application section 721 of the subsidiary lever 72 and the levering section 412 of the lever 41 are positioned on different sides. The elastic element 73 is disposed between the subsidiary lever 72 and the main body 20. The elastic element 73 exerts elastic force onto the subsidiary lever 72 to keep the force application section 721 of the subsidiary lever 72 levered upward, while the pushing section 722 levered downward in normal state. In this embodiment, the subsidiary lever 72 has two side-by-side arranged plate bodies. Each plate body is pivotally disposed at the lug 711 of the shafted block 71 via a pivot member 723. In this embodiment, the pushing section 722 of the subsidiary lever 72 is formed as two legs positioned under the levering section 412. In this embodiment, there are two elastic elements 73, which are torque springs each having an annular body section and two leg sections. The annular body section is fitted on the pivot member 723, while the two leg sections respectively abut against the main body 20 and the subsidiary lever 72 as shown in FIG. 3. The two elastic elements 73 exert elastic force onto the application section 721 to push the application section 721 upward so as to move the pushing section 722 downward.

A first cap 46 and a second cap 76 are respectively capped on the levering section 412 of the lever 41 and the application section 721 of the subsidiary lever 72 so as to beautify the appearance and facilitate pressing of the lever 41 and the subsidiary lever 72. The two caps 46, 76 are only denoted in FIGS. 3 and 4.

The down-pressed clamp base 10 of the present invention is mounted on a rail 80 of a racket stringer (not shown). When stringing the racket, the clamp base 10 serves to hold the string of the racket. The rail 80 is formed with a slide slot 81. After the connection rod 511 of the fastening mechanism 50 is fitted through the slide slot 81, the clamping block 52 is screwed onto the connection rod 511. The string holding operation of the string holding mechanism 60 is not the subject of the present invention and thus will not be redundantly described hereinafter.

Please refer to FIGS. 2 and 4, which show that the down-pressed clamp base 10 is not locked on the rail 80. Under such circumstance, the levering section 412 of the lever 41 of the leverage mechanism 40 is levered upward and a gap exists between the clamping block 52 of the fastening mechanism 50 and the bottom face of the rail 80 without fastening the rail 80. Therefore, the clamp base 10 is in a released state and freely slidable along the rail 80 to adjust the position.

Figure 5:
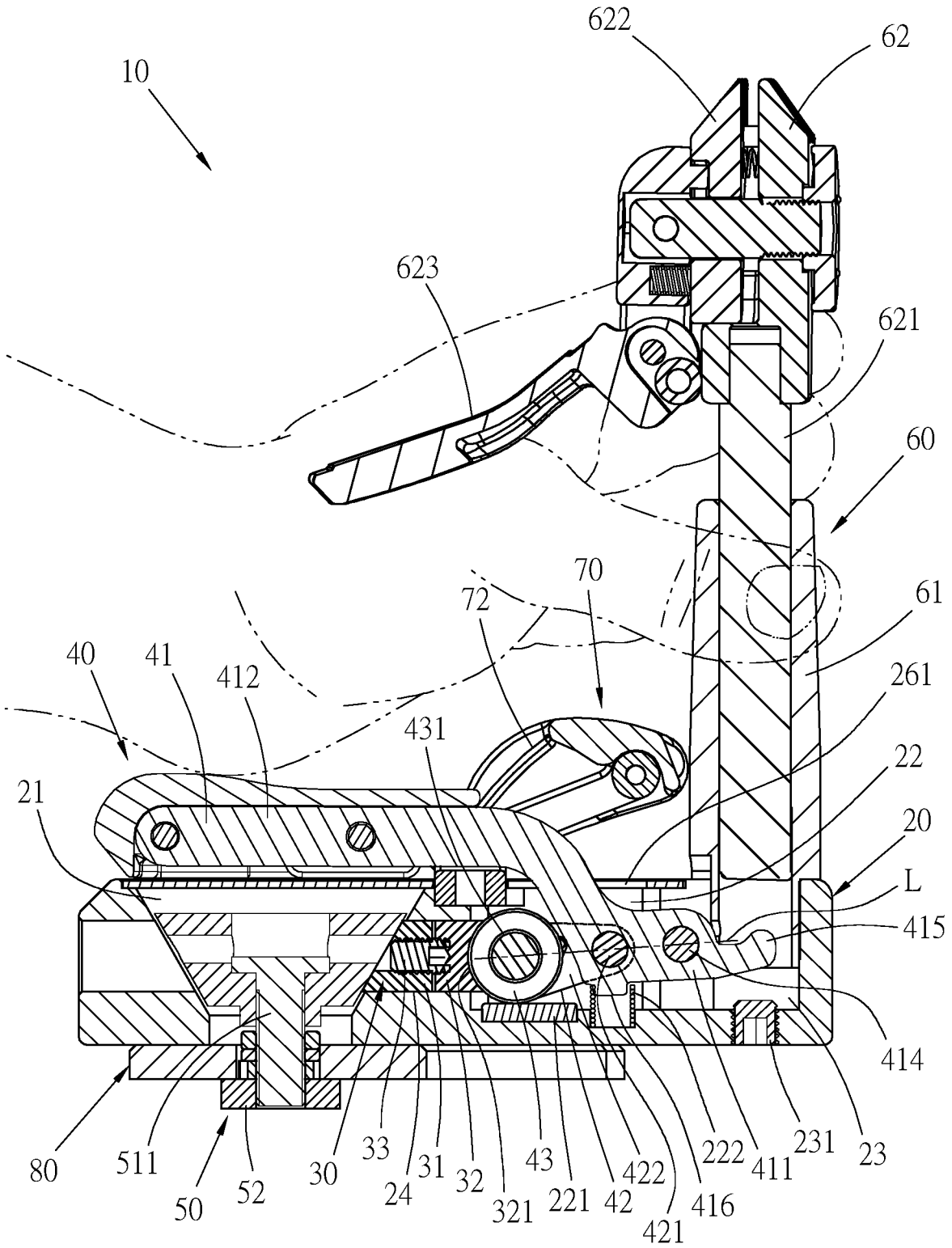
FIG. 5 is a sectional view showing that the lever is pressed down with a palm to lock the down-pressed clamp base.

As shown in FIG. 5, when it is desired to fix the down-pressed clamp base 10 on the rail 80, the levering section 412 of the lever 41 is pressed down. At this time, the lever 41 is angularly displaced to push the transmission member 30 to move toward the conic hole 21 via the link 42. Accordingly, the transmission member 30 pushes the conic block 51 to move upward. At this time, the conic block 51 pulls the connection rod 511 and the clamping block 52 upward, whereby the clamping block 52 is fastened with the bottom of the main body 20 and affixed to the rail 80. In this case, the string holding mechanism 60 can be used to hold the string.

To speak more specifically, as shown in FIG. 5, a user can press down the levering section 412 of the lever 41 with his palm. At this time, the levering section 412 will swing downward with the pivoted end 411 serving as a fulcrum and drive the link 42 to swing. The free end of the link 42 is displaced in a direction to the transmission member 30, whereby via the rolling member 43, the link 42 pushes the transmission member 30 toward the conic hole 21. The rolling member 43 is in rolling contact with the arched block 32 so that the rolling member 43 can more smoothly push the transmission member 30. In addition, when the free end of the link 42 is displaced, the rolling member 43 rolls on the pad body 221. When the link 42 pushes the transmission member 30, the slope block 31 is moved into the conic hole 21 and the slope 311 of the slope block 31 pushes the conic block 51 to move upward. At this time, the conic block 51 drives the clamping block 52 to move upward via the connection rod 511 so as to minify the gap between the clamping block 52 and the bottom of the main body 20, whereby the clamping block 52 is fastened with the bottom face of the rail 80. When the levering section 412 is moved to the dead end of the fastening travel, the pivot point of the pivoted end 411 of the lever 41, (that is, the center of the pin member 414) and the two ends of the link 42, (that is, the center of the shaft rod 421 and the center of the pivot pin 431) are positioned in the same straight line L. When the leverage mechanism 40 is positioned at the dead end of the downward pressing travel, the three pivot points are positioned in the same straight line. By means of such design, the lever 41 and the link 42 provide a stable locking effect without loosening. Also, the transmission member 30 and the fastening mechanism 50 are stably and quantitatively tightened, whereby the fastening mechanism 50 can quantitatively fasten the rail 80, that is, the clamping block 52 can be fastened in a fixed position. Therefore, in each fastening operation, the leverage mechanism 40 and the fastening mechanism 50 are both stably locked and the travel of the link 42 pushing the transmission member 30 is fixed. Also, the transmission member 30 pushes the conic block 51 to move upward by a fixed height. Therefore, in each fastening operation, the gap between the clamping block 52 and the main body 20 and the fastening force are fixed. The elastic member 222 is compressed by the lever 41 to store an elastic energy.

Figure 6:
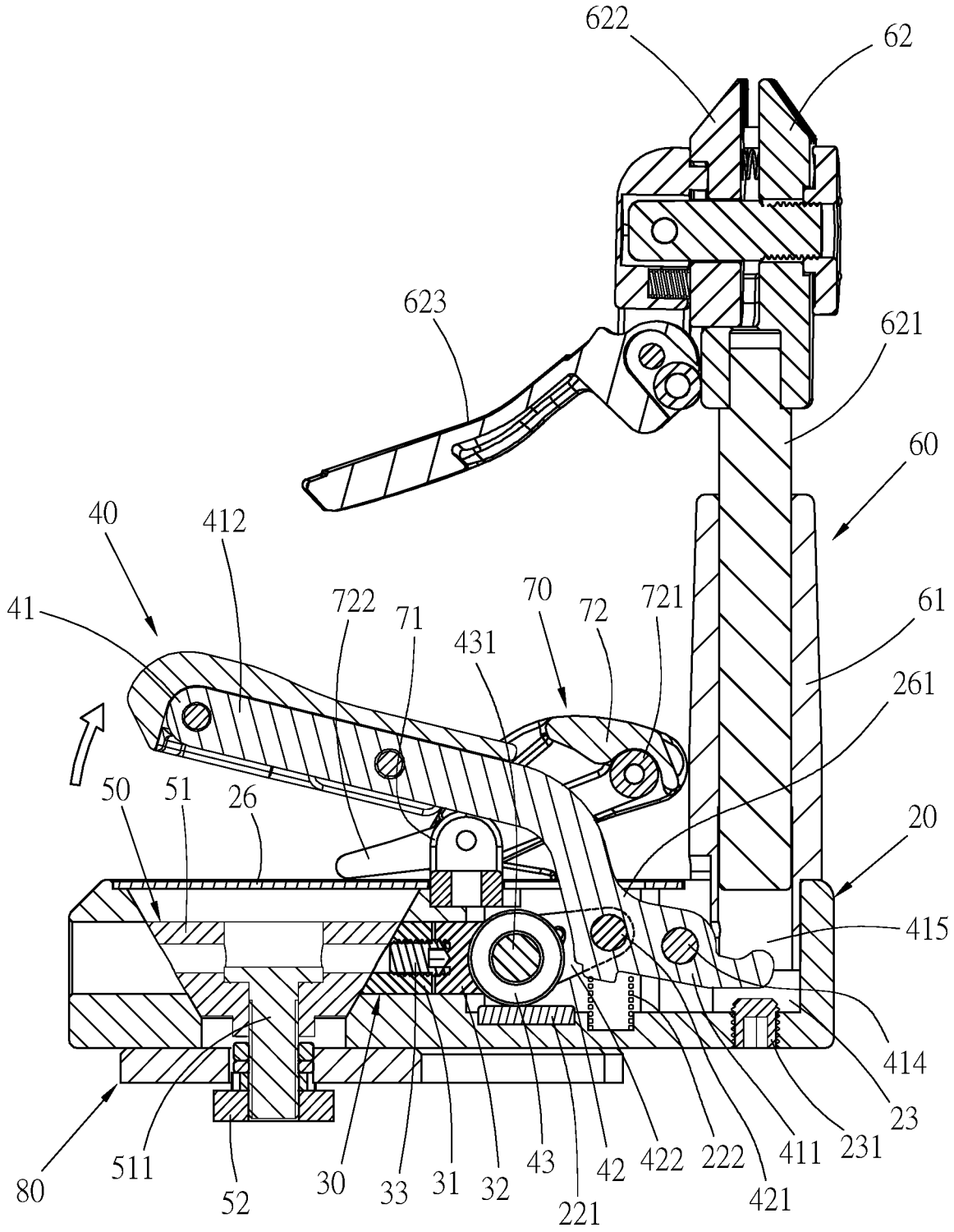
FIG. 6 is a sectional view showing that the down-pressed clamp base is unlocked by means of the lever.

When it is desired to release the down-pressed clamp base 10 from the fastening state, there are three ways to achieve this. First, as shown in FIG. 6, an operator can upward shift the levering section 412 of the lever 41 so as to make the pivot point of the pivoted end 411 of the lever 41, (that is, the center of the pin member 414) and the two ends of the link 42, (that is, the center of the shaft rod 421 and the center of the pivot pin 431) become non-collinear. Under such circumstance, the leverage mechanism 40 is unlocked. Once the lever 41 is moved upward, the elastic member 222 will exert an elastic reaction force to quickly push the lever 41 upward. When the lever 41 is moved upward, the link 42 and the rolling member 43 are driven to move in a direction away from the transmission member 30. At this time, the slope block 31 of the transmission member 30 no more forcedly abuts against the conic block 51 so that the conic block 51 will fall down due to its own weight. Accordingly, the conic block 51 will push the transmission member 30 toward the passage 22. The clamping block 52 will be lowered along with the conic block 51 without fastening the rail 80. In this case, the clamp base 10 is restored to the released state and can move along the rail.

Figure 7:
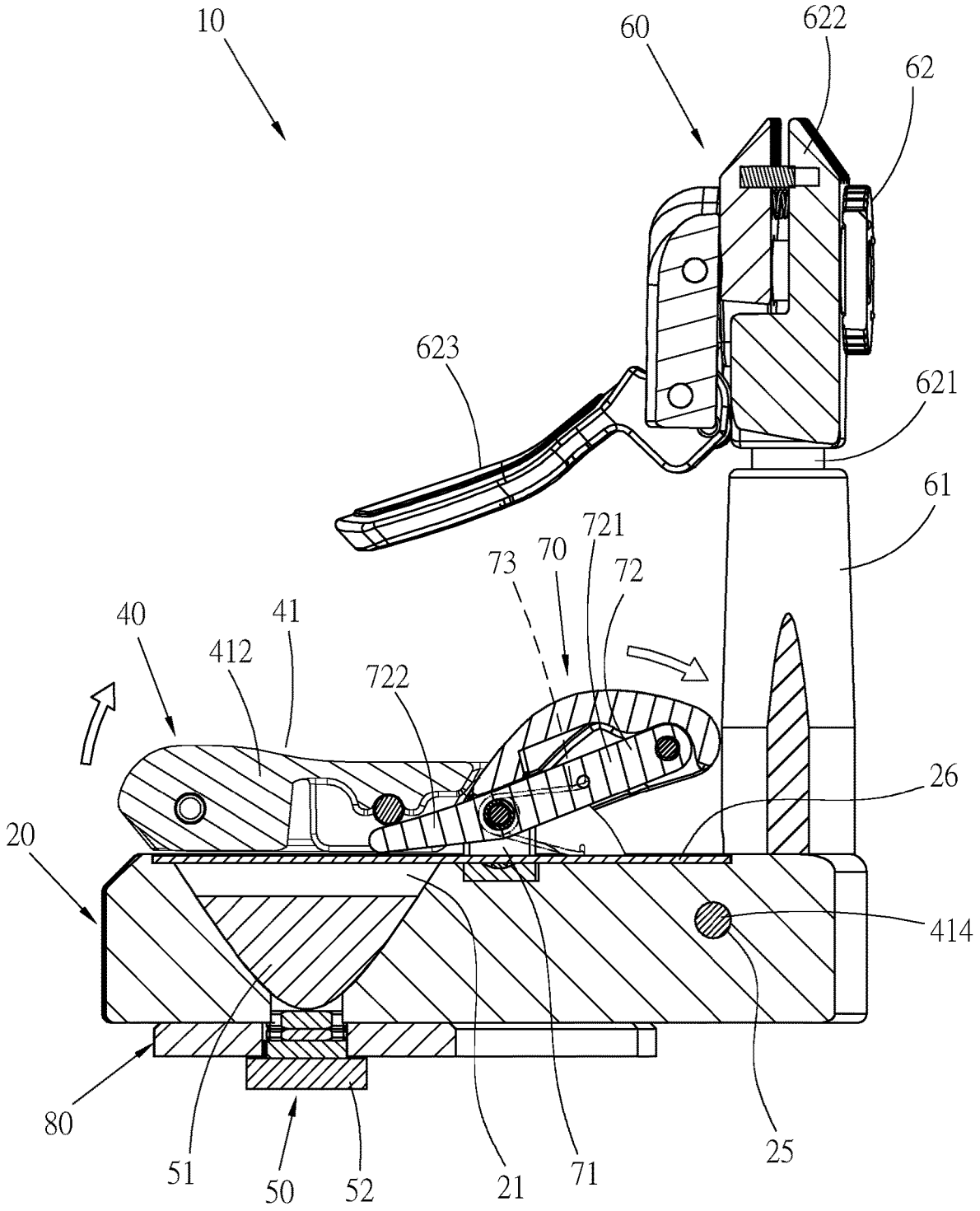
FIG. 7 is a sectional view showing that the down-pressed clamp base is unlocked by means of the subsidiary lever.

Please refer to FIG. 7, which shows the second way to unlock the string holder 10 of the present invention. As shown in the drawings, when the clamp base 10 is in the locked state, an operator can press down the force application section 721 of the subsidiary lever 72 of the subsidiary leverage assembly 70, whereby the pushing section 722 at the other end of the subsidiary lever 72 is levered up. At this time, the pushing section 722 pushes the levering section 412 of the lever 41 to move upward so as to unlock the leverage mechanism 40 and restore to the state as shown in FIG. 4, in which the clamping block 52 of the fastening mechanism 50 no more fastens the rail 80. After the subsidiary lever 72 is released from the applied force, the two elastic elements 73 exert elastic force to urge the force application section 721 to move upward, whereby the pushing section 722 is moved downward and the subsidiary lever 72 is restored to the state as shown in FIG. 4 for next use.

Figure 8:
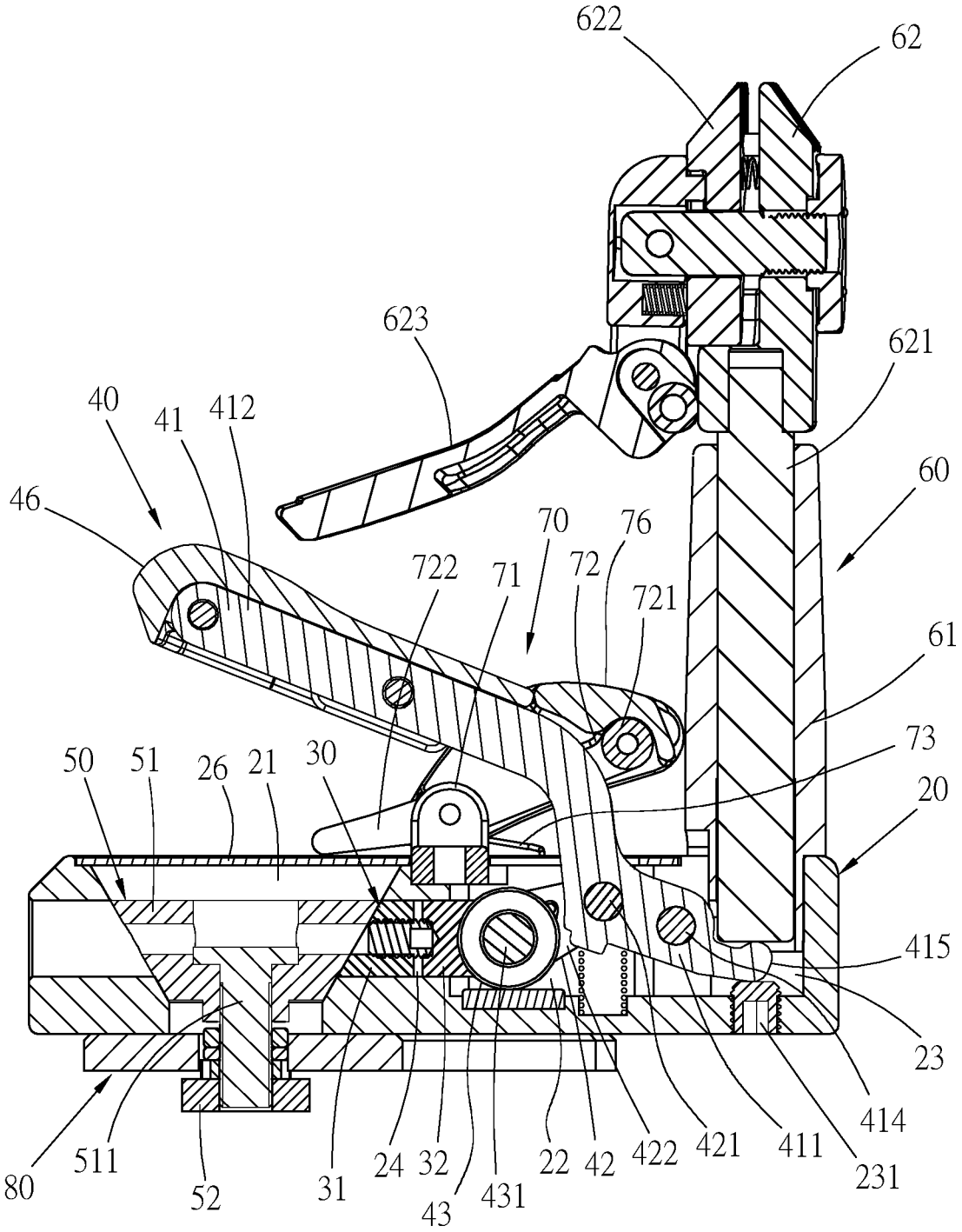
FIG. 8 is a sectional view showing that the down-pressed clamp base is unlocked by means of the string holding mechanism.

Please refer to FIG. 8, which shows the third way to unlock the clamp base 10 of the present invention. When an operator use the string holding mechanism 60 to hold the racket string in another position, the clamp member 62 is released without further holding the string. At this time, the clamp member 62 will fall down due to gravity, whereby the bottom end of the stem body 621 of the clamp member 62 will hit the pressing section 415 of the lever 41 positioned in the receiving cavity 23 to drive the lever 41 to swing and make the levering section 412 move upward. Such operation manner can also make the levering section 412 of the lever 41 move upward to make the three pivot points become non-collinear and release the clamp base 10, whereby the clamp base 10 can be moved again.

Figure 9:
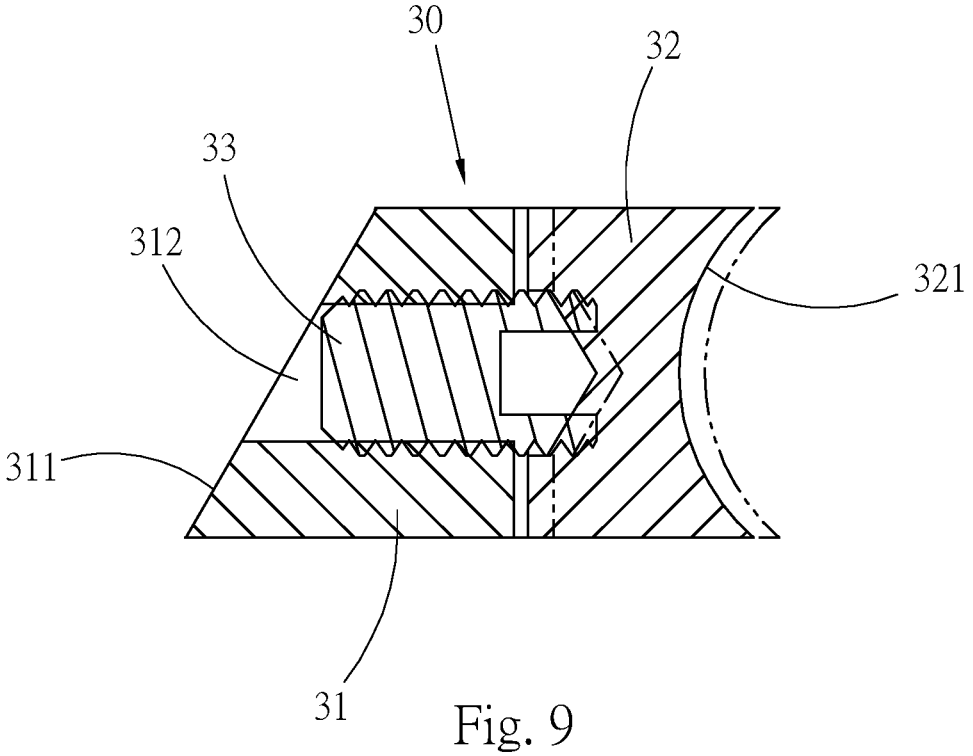
FIG. 9 is a sectional view showing that the length of the transmission member is adjustable.

Moreover, please refer to FIG. 9. The adjustment member 33 of the transmission member 30 can be screwed within the threaded hole 321 to adjust the position and change the length of the transmission member 30. When the length of the transmission member 30 is increased, in operation, the transmission member 30 will push the conic block 51 to a higher position so as to increase the fastening extent of the fastening mechanism 50. Reversely, when the length of the transmission member 30 is reduced, the transmission member 30 will push the conic block 51 to a lower position. In this case, the clamping block 52 is moved upward by a shorter distance so that the fastening extent of the fastening mechanism 50 is reduced.

Figure 10:
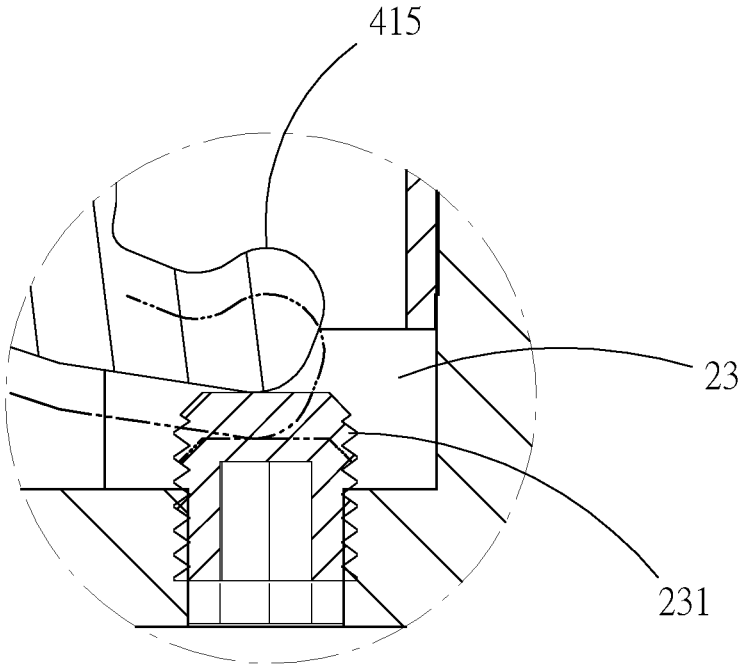
FIG. 10 is an enlarged view of a part of FIG. 4, showing that the move-up travel of the lever is adjusted by means of the adjustment member.

Please now refer to FIG. 10. An operator can adjust the height of the adjustment member 231 positioned in the receiving cavity 23. Accordingly, he bottom of the pressing section 415 of the lever 41 is restricted, whereby the lifting height of the levering section 412 is restricted. Accordingly, the height of the adjustment member 231 can be adjusted as required so as to change the lifting height of the levering section 412.

In the down-pressed clamp base of the present invention, the leverage mechanism 40 is operated by means of pressing up and down the lever 41. An operator can apply a force to the lever 41 with his palm to press down the lever 41. Such force application manner meets ergonomics and the operation is labor-saving and convenient. Moreover, even after a long period of operation, the muscle of the operator will not be hurt. Also, each time the leverage mechanism 40 is forcedly pressed down, the force applied by the link 42 to the transmission member 30 for pushing the fastening mechanism 50 is fixed. Therefore, the fastening mechanism 50 will not stuck or fail to release due to over-forcing. Furthermore, when unlocking the clamp base, there are three ways to loosen the leverage mechanism 40, that is, levering the lever 41 upward, pressing down the subsidiary lever 72 or dropping down the clamp member 62. An operator can select any of the three ways to unlock the clamp base according to the current operation condition or personal use habit so that the operation is facilitated.

The structure of the down-pressed clamp base of the present invention is such designed that the down-pressed clamp base can be operated in a novel mode different from the rotation operation manner of the rotary bar of the conventional clamp base. Also, the down-pressed clamp base of the present invention can solve many shortcomings of the conventional clamp base.

The above embodiments are only used to illustrate the present invention, not intended to limit the scope thereof. Many modifications of the above embodiments can be made without departing from the spirit of the present invention.

What is claimed is:

1. A down-pressed clamp base comprising: a main body having a space passing through a bottom of the main body and a passage communicating with the space via a connection perforation; a transmission member slidable disposed in the connection perforation, two ends of the transmission member being respectively directed to the passage and the space; a leverage mechanism including a lever and a link, wherein the lever has two ends, one end of the lever being a pivoted end pivotally connected with the main body, the other end of the lever being a levering section, the pivoted end of the lever having a pivot point, the lever being rotatable around the pivot point, wherein the link has two ends, one end of the link being a pivoted part pivotally connected with the lever, the other end of the link being a free end positioned in the passage and directed to the transmission member, when the levering section of the lever is rotated downward, the link being driven, whereby the free end of the link drives the transmission member to displace toward the space; a fastening mechanism disposed in the space, when the transmission member is displaced toward the space, the fastening mechanism being driven; and a string holding mechanism disposed on the main body, a clamp member being disposed on a top section of the string holding mechanism.

2. The down-pressed clamp base as claimed in claim 1, further comprising a subsidiary leverage assembly having a subsidiary lever pivotally disposed on the main body, one end of the subsidiary lever being a force application section, the other end of the subsidiary lever being a pushing section corresponding to the levering section of the lever, whereby when operating the force application section of the subsidiary lever, the pushing section pushes the levering section of the lever to move upward.

3. The down-pressed clamp base as claimed in claim 2, further comprising at least one elastic element disposed on the subsidiary lever, when the subsidiary lever is not forced, the elastic element making the pushing section of the subsidiary lever away from the levering section of the lever.

4. The down-pressed clamp base as claimed in claim 1, wherein a receiving cavity is disposed at an end of the main body opposite to the space, the receiving cavity communicating with the passage, a pressing section protruding from a rear end of the pivoted end of the lever, the pressing section being positioned in the receiving cavity, the string holding mechanism having a hollow tube disposed on the receiving cavity, a stem body being disposed under the bottom section of the clamp member, the stem body being slidably fitted in the tube, whereby when the clamp member drops down, a bottom end of the stem body can press the pressing section.

5. The down-pressed clamp base as claimed in claim 4, wherein an adjustment member is disposed on the bottom of the receiving cavity, a height of the adjustment member in the receiving cavity being adjustable, whereby when the levering section of the lever is rotated upward, the pressing section can touch the adjustment member.

6. The down-pressed clamp base as claimed in claim 1, wherein a rolling member is disposed at the free end of the link, whereby the free end of the link drives the transmission member via the rolling member.

7. The down-pressed clamp base as claimed in claim 1, wherein when the levering section of the lever is downward rotated, the levering section has a dead end, when the lever is positioned at the dead end, the pivot point of the lever, the pivoted part of the link and the free end of the link being positioned in a same straight line.

8. The down-pressed clamp base as claimed in claim 6, wherein the rolling member is pivotally connected with the free end of the link via a pivot pin, when the levering section of the lever is downward rotated, the levering section having a dead end, when the lever is positioned at the dead end, the pivot point of the lever, the pivoted end of the link and the pivot pin being positioned in a same straight line.

9. The down-pressed clamp base as claimed in claim 6, wherein a pad body is disposed on the bottom of the passage and the rolling member is positioned on the pad body.

10. The down-pressed clamp base as claimed in claim 1, wherein an elastic member is disposed in the passage, the elastic member applying an elastic force to the lever to keep the levering section of the lever upward.

11. The down-pressed clamp base as claimed in claim 1, wherein the fastening mechanism includes an operation block and a clamping block, the operation block being received in the space and pushed by the transmission member to move up and down within the space, the clamping block being positioned outside the main body and connected with the operation block to move upward and down along with the operation block.

* * * * *